United States Patent [19]

Hikita et al.

[11] Patent Number: 4,914,411

[45] Date of Patent: Apr. 3, 1990

[54] ELECTRO-MAGNETIC RELAY

[75] Inventors: Hiroshi Hikita; Katsumi Shibata; Hideo Oishi; Hiroshi Yoshikawa, all of Kanagawa, Japan

[73] Assignee: Fuji Electric Co., Ltd., Kanagawa, Japan

[21] Appl. No.: 295,704

[22] Filed: Jan. 9, 1989

[30] Foreign Application Priority Data

Jan. 26, 1988 [JP] Japan ..... 63-15144
Mar. 11, 1988 [JP] Japan ..... 63-57824

[51] Int. Cl.[4] ..... H01H 67/02

[52] U.S. Cl. ..... 335/128; 335/78; 335/85

[58] Field of Search ..... 335/78–85, 335/124, 128, 129, 130, 131, 202, 203, 278, 250, 279, 199

[56] References Cited

U.S. PATENT DOCUMENTS 4,734,668 3/1988 Dittmann ..... 335/128

FOREIGN PATENT DOCUMENTS 59-31537 2/1984 Japan .

*Primary Examiner*—Leo P. Picard
*Assistant Examiner*—L. Donovan
*Attorney, Agent, or Firm*—Finnegan, Henderson, Farabow, Garrett and Dunner

[57] ABSTRACT

The electro-magnet relay of the present invention utilizes an iron core and an armature both formed as flat plates stacked together. Further, a stationary leaf spring and a moveable leaf spring are provided in the middle section of the iron core having two legs and being shaped as an inverted U. The armature is supported in a hole located in the insulating substrate and may swing to a degree determined by a striking piece formed on the armature. Coil terminals and contact terminals protruding from the bottom of the insulating substrate are arranged in a single line in the electro-magnetic relay of the present invention and may be installed on a high density printed circuit board.

7 Claims, 5 Drawing Sheets

ELECTRO-MAGNETIC RELAY

FIELD OF THE INVENTION

The present invention relates to an extremely small electro-magnetic relay mounted on a printed circuit board.

BACKGROUND OF THE INVENTION

Conventionally, electro-magnetic relays include a yoke made of a plate and an iron core, having an exciting coil wound on a coil bobbin, fixedly secured to form an electro-magnet. Generally, the yoke and iron core-coil combination are secured by staking. An armature is supported through a leaf spring on the yoke such that it is arranged between the yoke and the pole piece of the electro-magnet. The leaf spring is used to restore the armature. Japanese Patent Application (OPI) No. 31537/1984 discloses an electro-magnetic relay including a stationary leaf spring with a stationary contact secured to an insulating stand, and a movable leaf spring with a movable contact is mounted through an insulating member on the armature so that it is swung back and forth together with the armature.

There is a large demand for the miniaturization of electro-magnetic relays used for input and output interfaces in electronic circuits. This demand corresponds to the demand for increased miniaturization and integration of electronic components.

As an electro-magnetic relay is miniaturized, the components such as the leaf springs must also be miniaturized, and extremely small connecting parts must be employed. Consequently, the components must be machined with a high degree of accuracy, and the assembling work must be performed with a high degree of precision. In order to increase the productivity of such a small electro-magnetic relay, to decrease the manufacturing cost, and to maintain the reliability of the product, the number of components must be minimized and the configurations of the components must be designed so that they readily can be machined and assembled.

The thickness of the conventional electro-magnetic relay is defined by the width of the yoke and the electro-magnet. The stationary leaf spring and the movable leaf spring are arranged outside of the yoke and the electro-magnet, and therefore, the internal space defined by these components is necessarily large. As a result, the ability to miniaturize the electro-magnetic relay is limited.

Efforts have been made to miniaturize the components. However, attempts to reduce the number of components, to simplify the configuration of components, and to improve the component assembling efficiency have not proven satisfactory. Indeed, as miniaturization of the components is increased, difficulties in machining and assembling the components have increased.

SUMMARY OF THE INVENTION

An object of the present invention is to overcome the problems and disadvantages of the prior art.

An object of the present invention is an improved spatial arrangement of the components of the electro-magnetic relay that efficiently utilizes the functions of the components.

Another object of the invention is a simplified components configuration having a more efficient component assembling.

A further object of the present invention is an electro-magnetic relay that is extremely small in size, reliable, and easy to produce.

These and other objects are accomplished in the electro-magnetic relay of the present invention wherein an iron core and an armature, each being in the form of a flat plate, are stacked together, and a stationary leaf spring and a movable leaf spring are arranged in the middle section iron core.

To achieve the objects and in accordance with the purpose of the present invention, as embodied and broadly described herein, the invention comprises an electro-magnetic relay having a rectangular insulating substrate, a gate-shaped iron core in the form of a flat plate having two leg portions and a middle portion. The iron core is secured to the insulating substrate with the ends of the two leg portions inserted into inserting holes formed in both end portions of the insulating substrate. Further, an exciting coil wound through a winding bobbin on the middle portion is provided. The exciting coil winding bobbin, being relatively flat and substantially U-shaped, forms a U-shaped groove into which the middle portion of the gate-shaped iron core is press-fitted. A stationary leaf spring and a movable leaf spring are secured to the insulating substrate so that the leaf springs are arranged inside of the middle of the iron core and along one side of the iron core. The stationary leaf spring and the movable leaf spring have a stationary contact and a movable contact on the confronting or inner surfaces, respectively. A flat plate-shaped armature is arranged along the other side of the iron core so that the armature abuts the rear surface of the movable leaf spring through an insulating member and bridges the two leg portions of the iron core. The armature is swingably supported with a leg piece formed at one end portion of the armature. The leg piece is inserted into a hole formed in the insulating substrate. A casing is fixedly engaged with the insulating substrate.

In the electro-magnetic relay of the present invention, the armature's degree of swing is regulated by a striking piece formed at the other end of the armature. The striking piece, in turn, is inserted into a groove formed in the insulating substrate. A stopper is provided of the armature, and the armature can be fixed by inserting it in one direction. Furthermore, the insulating material is designed as to be elastically mounted on the armature and thus is mounted by one action.

A protrusion is extended from the top plate of the casing so that when the casing is faced in the opposite direction for engagement with the insulating substrate, the protrusion abuts the top of the coil terminals. This protrusion prevents the further movement of the casing and thus prevents erroneous assembling of the casing.

Coil terminals and contact terminals protruding from the bottom of the insulating substrate are arranged in one line in the electro-magnetic relay. Therefore, the components can be installed on a high density printed circuit board.

The winding bobbin readily can be molded without increasing the number of the components needed. Moreover, the winding bobbin can be mounted on the iron core by one action, thereby simplifying the relay assembling work.

In the operating electro-magnet, the leg piece of the armature is inserted into a hole formed in the insulating substrate. With this construction, an additional part for supporting the armature is unnecessary. Additionally, the armature is fixed by inserting it in one direction, again simplifying the relay assembling work.

In the operating electro-magnet of the present invention, a recess is formed in the upper surface of the armature so that the recess is aligned with the axis of the leg piece. A protrusion is formed on one side of the gate-shaped iron core so that the protrusion is engageable with the recess. Once engaged, the swing or lift of the armature can be prevented without additional parts.

Furthermore, a wall member is formed in the operating electro-magnet integral with the insulating member so that it abuts the outside of the armature. The outward falling of the armature thus can be eliminated without additional parts.

The plate-shaped components are stacked with the stationary leaf spring and the movable leaf spring which are arranged inside the middle section of the gate-shaped iron core. As a result, the thickness of the electro-magnetic relay is considerably small. Moreover, the width and the length of the relay are substantially equal to those of the gate-shaped iron core. The electro-magnetic relay of the present invention is simple in construction having the number of components reduced. The reduction in components is a result of the following factors, the iron core being formed of the gate, or inverted U-shaped, the yoke being integral with the iron core, the use of the movable leaf spring to restore the armature, and supporting the armature directly with the hole formed in the insulating substrate thereby eliminating the need for an additional part to support the armature. Furthermore, the components are simplified in configuration and are so designed as to be inserted or fitted in one and the same direction. Therefore, the components readily can be manufactured and the relay assembling work can be carried out in an automation mode.

BRIEF DESCRIPTION OF THE DRAWINGS

The accompanying drawings, which are incorporated in and constitute a part of this specification, illustrate several embodiments of the present invention and together with the description, serve to explain the principles of the present invention.

DESCRIPTION OF THE PREFERRED EMBODIMENT

Figure 1:
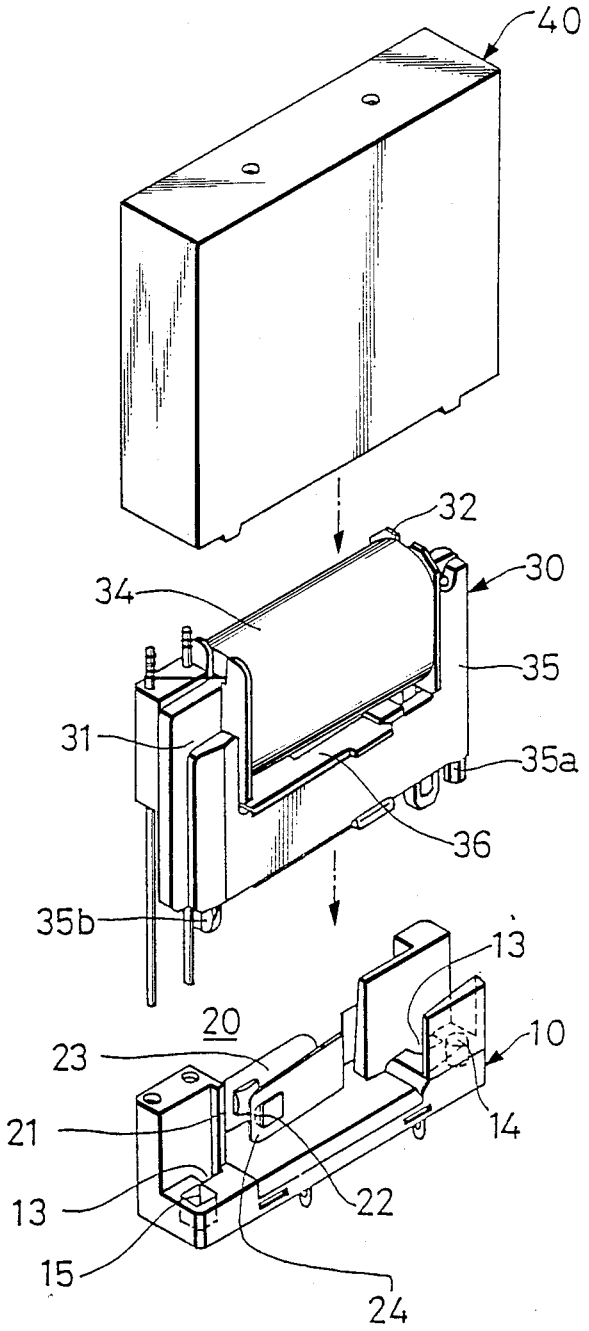
FIG. 1 is a perspective view of the electro-magnetic relay of the present invention.

FIG. 1 shows the electro-magnetic relay of the present invention having four parts including an insulating substrate 10, a leaf spring member 20, an operating electro-magnet 30, and a casing 40. Each of these element will subsequently be described.

Figure 2:
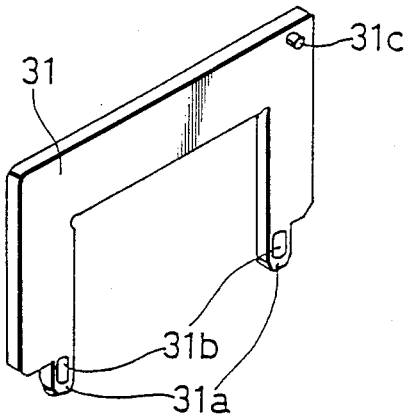
FIG. 2 is a perspective view of the gate-shaped iron core of the present invention.

FIG. 2 shows a gate-shaped or inverted U shaped iron core 31 located in the operating electro-magnet 30. The iron core 31 is formed by blanking an iron sheet having two leg parts. Two inserting pieces 31*a* extend from the ends of the two leg parts of the gate-shaped iron core 31, respectively. A small elliptic press fitting protrusion 31*b* is formed on a first side of each of the inserting pieces 31*a* by pressing. A cylindrical protrusion 31*c* is formed on the first side of the gate-shaped iron core 31 and is located above one of the leg parts of the iron core 31*c*. The cylindrical protrusion 31*c* is used to prevent the lift of the armature. The blanking of the gate-shaped iron core 31 and the formation of the protrusions 31*b* and 31*c* readily can be achieved by pressing.

Figure 3:
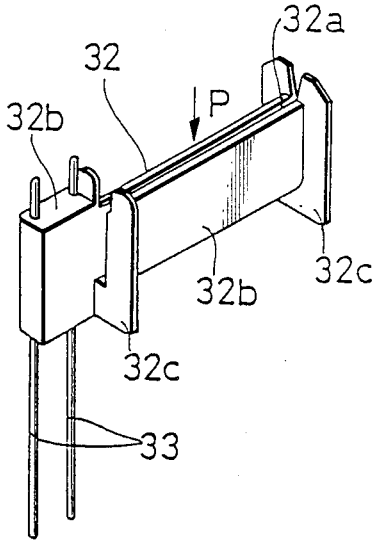
FIG. 3 is a perspective view of the exciting coil winding bobbin of the present invention.

FIG. 3 shows an exciting coil winding bobbin 32. The winding bobbin 32 comprises a U-shaped winding barrel 32*b* in section with a U-shaped groove 32*a*. Two U-shaped flanges 32*c* are provided at both ends of the winding barrel 32*b*. A terminal part 32*d* merges with one of the flanges 32*c* and is located at one end of the winding bobbin 32. These components are formed into one unit by molding resin. In this operation, coil terminals 33 are embedded in the terminal part 32*d*.

Figure 4:
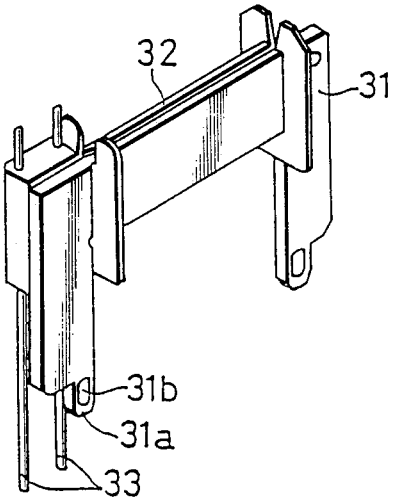
FIG. 4 is a perspective view of the winding bobbin of FIG. 3 combined with the iron core of FIG. 2.

FIG. 4 shows the winding bobbin 32 in cooperation with gate-shaped iron core 31. The middle part of the gate-shaped iron core 31 is press fitted in the direction of the arrow P, shown in FIG. 3, into the U-shaped groove 32*a* of the winding bobbin 32. One method of combining the exciting coil winding bobbin with the iron core is to mold the winding frame onto the iron core. However, this method is not practical because the iron core may be damaged when the mold is tightened. Moreover, since the mold design is complicated it is expensive to manufacture. In another method of combining the winding bobbin and iron core, the winding bobbin is divided into two parts, and the iron core is held between the two parts. However, this method also is problematic in that it requires an increased number of components thereby increasing the assembly time. The method of combining the iron core and the winding bobbin as shown in FIG. 4 is more desirable because it is free of the aforementioned difficulties. The method shown in FIG. 4 employs a small mold that is suitable for mass production, and the iron core can be inserted into the winding bobbin in one direction.

Figure 5:
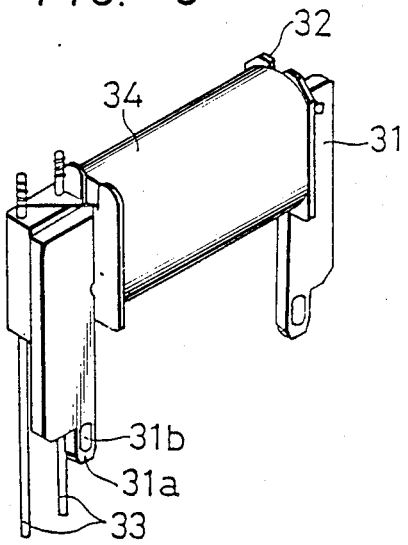
FIG. 5 is a perspective view of the exciting coil wound on the bobbin shown in FIG. 4.

FIG. 5 shows an exciting coil 34 wound on the winding bobbin 32 and the gate-shaped iron core 31, having been combined as described above. The two ends of the exciting coil 34 are connected to the upper ends of the coil terminals 33, respectively.

Figure 6:
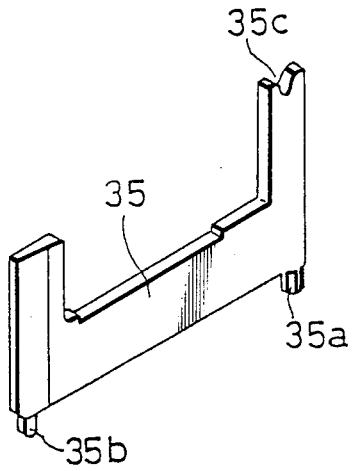
FIG. 6 is a perspective view of the armature of the present invention.

FIG. 6 shows the armature 35 of the electro-magnetic relay prepared by blanking an iron plate into an inverted-gate-shape, or U-shape. A leg piece 35*a* extends downwardly from one end portion of the lower surface of the armature 35. The leg piece 35*a* is required to support the armature 35. A striking piece 35*b* extends downwardly from the other end portion of the lower surface of the armature. The striking piece 35*b* regulates the angle of swing of the armature 35. The function of the striking piece 35*b* will be described subsequently. A recess 35*c* is formed in the upper surface of the armature 35 in alignment with the axis of the leg pieces 35*a*. The recess 35*c* engages the protrusion 31*c* of the gate-shaped iron core 31.

Figure 8:
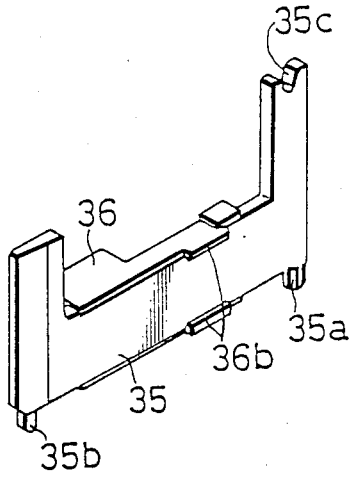
FIG. 8 is a perspective view of the operating piece of FIG. 7 mounted on the armature of FIG. 6.
Figure 7A:
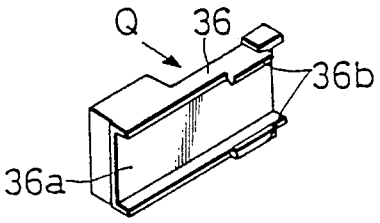
FIG. 7(A) is a perspective view of the operating piece of the present invention.
Figure 7B:
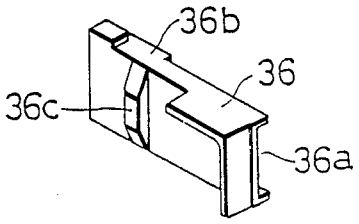
FIG. 7(B) is a perspective view of the operating piece viewed in the direction of the arrow Q shown in FIG. 7(A)

FIG. 7(A) shows the operating piece 36 of the insulating material as viewed from the right-hand side. FIG. 7(B) shows the operating piece 36 as viewed from the left-hand side or as viewed in the direction of arrow Q, shown in FIG. 7(A). A groove 36*a*, having a depth corresponding to the thickness of the armature 35, is provided on the mounting surface of the operating piece 36. The operating piece 36 is mounted on the armature 35. Locking pieces 36*b* extend from both sides of the groove 36*a*. A striking part 36*c* is formed on the rear surface of the operating piece 36 to abut the rear surface of a movable leaf spring. The operating piece 36 is lifted elastically onto the middle part of the armature 35 and locked into place with the locking pieces 36*b*. FIG. 8 shows the operating piece 36 mounted on the armature 35.

Figure 9:
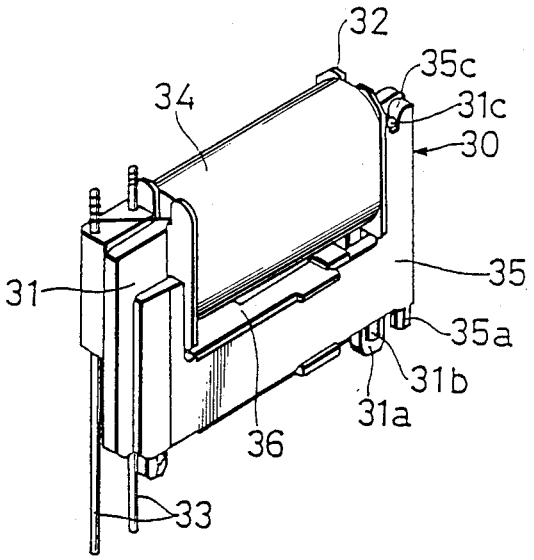
FIG. 9 is a perspective view of the operating electro-magnet of the present invention.

FIG. 9 shows the armature 35 and the operating piece 36 assembled and combined with the gate-shaped iron core 31 and exciting coil 34 assembly shown in FIG. 5. The armature 35 is combined with the gate-shaped iron core 31 so that the operating piece 36 is on the side of the iron core 31. In this operation, the recess 35*c* of the armature 35 is engaged with the protrusion 31*c* of the iron core 31. The engagement of the recess 35*c* and protrusion 31*c* prevents the swing or lift of the armature in its plane.

Figure 10:
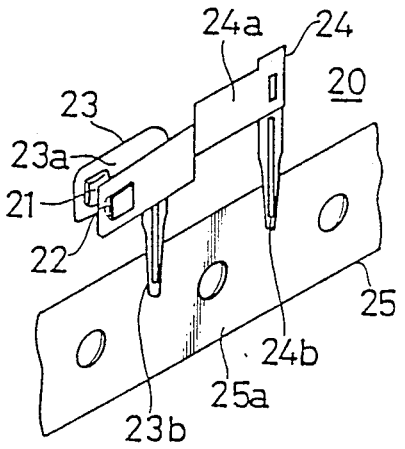
FIG. 10 is a perspective view of the leaf spring member of the present invention.

FIG. 10 shows the leaf spring member 20 comprising a stationary leaf spring 23 with a stationary contact 21 on the inner or confronting surface of the stationary leaf spring 23. A movable leaf spring 24 having a movable contact 22 on the inner or confronting surface thereof is provided. The leaf springs are formed by simultaneously blanking a phosphor bronze plate 25. The contacts 21 and 22 are fixedly secured to the plate 25 by peening before the blanking of the plate 25.

The stationary leaf spring 23 comprises a contact stand 23*a* supporting the stationary contact 21, and a contact terminal 23*b* extending from one end of the contact stand 23*a* perpendicular to the axis of the contact stand 23*a*. The stationary leaf spring 23 is substantially L-shaped. The movable leaf spring 24 comprises a contact stand 24*a* supporting the movable contact 22 and a contact terminal 24*b* extending from the contact stand 24*a*. The movable leaf spring 24 is substantially L-shaped. The contact stand 24*a* is relatively long to allow it to elastically swing back and forth. As shown in FIG. 10, when the stationary and movable leaf springs are formed by blanking the plate 25, the contract stand 24*a* is located above the stationary leaf spring 23. As shown in FIG. 10, the contact stand 24*a* is folded forwardly, and the middle part is bent so that the contents 21 and 22 face one another.

FIG. 10 shows that the end portions of the contact terminals 23*b* and 24*b* of the stationary leaf spring 23 and the movable leaf spring 24, respectively, remaining connected to the base part 25*a*. The base part 25*a* remains after the blanking of the phosphor bronze plate 25. After the stationary leaf spring 23 and the movable leaf spring 24 are secured to the insulating substrate 10, they are cut off the base part 25*a*.

Figure 11:
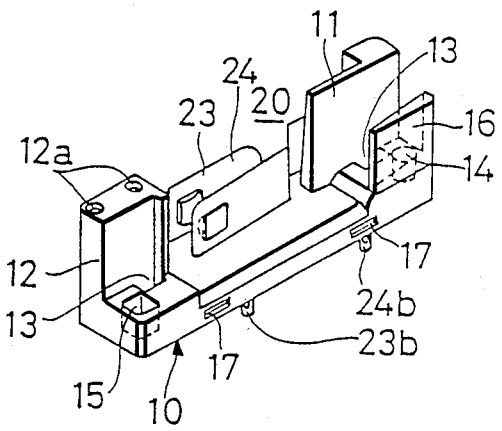
FIG. 11 is a perspective view of the insulating substrate of the present invention having the leaf spring member of FIG. 10 fixedly secured thereto.

FIG. 11 shows the insulating substrate 10 of mold resin, and the leaf spring member 20 secured to the insulating substrate 10. The insulating substrate 10 is substantially rectangular. The leaf spring member 20 is secured to one side of the insulating substrate 10. The contact terminals 23*b* and 24*b* protrude from the bottom of the substrate 10. The leaf spring member 20 is partially buried in the insulating substrate 10 when the substrate 10 is molded by so-called "inster molding".

A wall member 11 extends upwardly from the upper surface of one end portion of the insulating substrate 10. Another wall member 12 extends upwardly from the upper surface of the other portion of the insulating substrate 10. As shown in FIG. 11, the surfaces of the two wall members are flush with one another. The wall member 12 has two terminal holes 12*a* into which the coil terminals 33 are inserted. The contact terminals 23*b* and 24*b*, and the terminal holes 12*a* are positioned in parallel straight lines along one side of the insulating substrate 10.

Rectangular inserting through-holes 13 are formed in both end portions of the insulating substrate 10. The through-holes 13 extend along the surfaces of the wall members 11 and 12. The inserting pieces 31*a* of the gate shaped iron core 31 are press-fitted into the respective inserting through-holes 13. A circular hole 14 is formed in one end portion of the insulating substrate 10 so that it is adjacent to the corner of the inserting through-hole 13 on the side of the wall member 11. The leg piece 35*a* of the armature 35 is inserted into the circular hole 14. Similarly, a rectangular groove 15 is formed in the end portion of the insulating substrate 10 opposite of the end portion in which the circular hole 14 is formed so that it is adjacent to the corner of the inserting through-holes 13 on the side of the wall member 12. The striking piece 35*b* of the armature 35 is inserted into rectangular groove 15 to regulate the angular of swing of the armature 35.

Additionally, another wall member 16 extends upwardly from the upper surface of the one end portion of the insulating substrate 10 where the wall member 11 is located to confront the wall member 11. The wall member 16 is flush with the side of the insulating substrate 10. The wall member 16 is necessary to prevent the armature 35 from falling outward. The inner surface of the wall member 16 is slightly inclined in compliance with the swing of the armature 35. Finally, as shown in FIG. 11, locking grooves 17 are provided for fixedly connecting the casing 40 with the insulating substrate 10. The holes and the wall members of the insulating substrate 10 extend in one direction. Thus, the insulating substrate 10 readily can be molded.

Figure 12A:
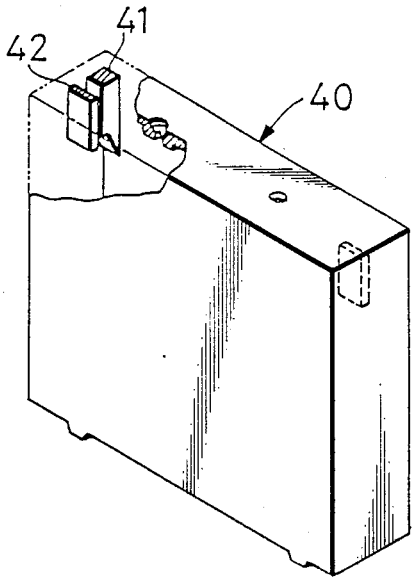
FIG. 12(A) is a perspective view of the casing of the present invention.
Figure 12B:
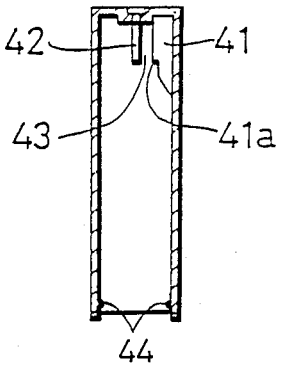
FIG. 12(B) is a vertical sectional view of the casing.

FIG. 12 shows the casing 40 having a stepped protrusion 41, and a flat protrusion 42 that extends downwardly from the top plate of the casing 40. The stepped protrusion 41 and the flat protrusion 42 are parallel to each other. As shown in the vertical sectional view of FIG. 12(B), the stepped protrusion 41, extends downwardly to the step 41*a*. Engaging protrusions 44, are engaged with the locking grooves 17 and extend form the lower edge of the casing 40.

The operating electro-magnet 30 is mounted on top of the insulating substrate 10. In this operation, the coil terminals 33 are inserted into the terminal holes 12*a*, of the insulating substrate 10. The inserting pieces 31*a* of the iron core 31 are press-fitted into the inserting holes 13 of the insulating substrate 10. The leg piece 35*a* and the striking piece 35*b* of the armature 35 are inserted into the hole 14 and the groove 15 of the insulating plate 10, respectively. As is apparent from the above description, the operating electro-magnet is readily combined with the insulating substrate 10 by inserting the electro-magnet in one direction. No additional parts are required to tightened the two together.

Figure 13:
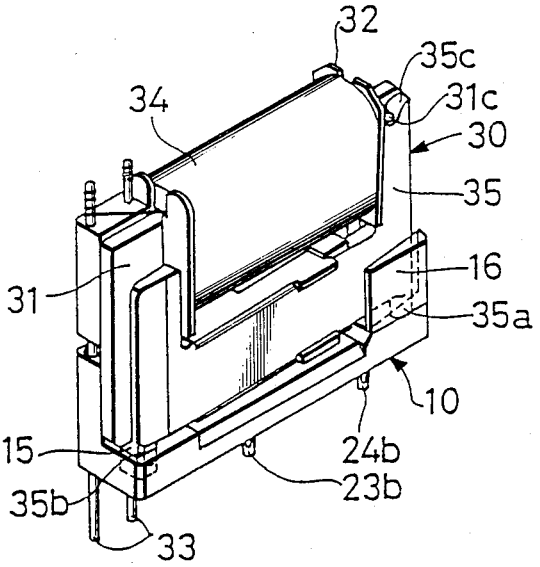
FIG. 13 is a perspective view of the operating electro-magnet of FIG. 9 combined with the insulating substrate of FIG. 11.

FIG. 13 shows the assembly of the insulating substrate 10 and the operating electro-magnet 30. As shown, the stationary leaf spring 23 and the movable leaf spring 24 are located in the middle section of the iron core 31, and the protruded part 36*c* of the operating pieces 36 abuts the rear surface of the movable leaf spring 24.

The armature 35 is elastically urged through the operating piece 36 by the movable leaf spring 24, which serves also as a restoring spring. The armature 35 is kept away from the iron core 31 until the exciting coil 34 is energized. The angle of swing of the armature 35 is regulated by the striking piece 35*b* striking located against the wall of the groove 15 that is formed in the insulating substrate 10. When the exciting coil 34 is energized, the armature 35 is swung about the leg piece 35*c*, thus being attracted by the gate-shaped iron core 31. As a result, the movable leaf spring 24 is pushed, or elastically deformed,so that the contacts 21 and 22 are brought into contact with each other.

The casing 40 fits on the peripheral side wall of the insulating substrate 10 so that the protrusions 41 and 42 are on the side of the recess 35*c* of the armature 35. The casing 40 is locked to the insulating substrate 20 with the protrusions 44 engaged with the locking grooves 17 in the insulating substrate 10. In this operation, the upper end portion of the iron core 31 is held by the protrusion 42 of the casing 40, while the protrusion 41 prevents the falling of the upper end portion of the armature 35 on the side of the swing fulcrum. If the casing 40 is faced in the opposite direction to engage with the insulating substrate 10, then the tops of the coil terminals 33 will strike against the step 41*a* of the stepped protrusion 41 in the casing 40. Thus, further movement of the casing 40 is prevented. The casing is so designed that it is correctly combined with the insulating substrate at all times.

In the electro-magnetic relay, the flat plate-shaped components are stacked, and the stationary leaf spring and the movable leaf spring are arranged in the middle section of the gate-shaped iron core. Therefore, the electro-magnetic relay may be made small in size. Furthermore, the yoke, the restoring spring, and the armature supporting components are eliminated. Thus, the number of components is decreased. The components can be formed by pressing or molding, and can be assembled easily by inserting or fitting them in one and the same direction. In summary, the electro-magnetic relay of the present invention can be made considerably small in size and can be manufactured at a low cost and at a high productivity level.

Other embodiments of the present invention will be apparent to those skilled in the art from consideration of the specification and practice of the disclosed invention. It is intended that the specification and examples be considered as exemplary only, with the true scope and spirit of the invention being represented by the following claims.

What is claimed is:

1. An electro-magnetic relay comprising:

an insulating substrate being rectangularly shaped and having two end portions containing inserting holes;

a gate-shaped iron core having first and second sides and formed of a flat plate shaped to include two leg portions and a middle portion positioned between said two leg portions, said two leg portions being received in said inserting holes of said insulating substrate;

a winding bobbin having an exciting coil wound thereon, said winding bobbin including one end at which a coil terminal is located, said winding bobbin being relatively flat and substantially U-shaped and including a U-shaped groove said middle portion of said iron core being press-fitted into said U-shaped groove of said winding bobbin;

a stationary leaf spring and a movable leaf spring fixedly secured to said insulating substrate and positioned at said middle portion of said iron core and along one of said two sides of said iron core;

said stationary leaf spring including a confronting surface on which a stationary contact is located, said stationary contact being supported by a first contact stand, a first contact terminal extends perpendicular to said first contact stand, and said movable leaf spring including a confronting surface on which a movable contact is located and having a rear surface, said movable contact being supported by a second contact stand, a second contact terminal extends perpendicular to said second contact stand;

a flat plate-shaped armature arranged along said first side of said iron core located opposite said stationary leaf spring and said movable leaf spring so that said armature abuts said rear surface of said movable leaf spring through an insulating member and bridges said two leg portions of said iron core, said armature having a first end portion and a second end portion and a leg piece formed on said end portion for swingably supporting said armature, said leg piece of said armature being inserted into one of said inserting holes of said insulating substrate; and a casing fixedly engaged with said insulating substrate.

2. An electro-magnetic relay according to claim 1, wherein said insulating substrate includes a groove for receiving a striking piece formed at said second end of said armature.

3. An electro-magnetic relay according to claim 1, further comprising an operating piece affixed to said insulating substrate and elastically fitted on said armature.

4. An electro-magnetic relay according to claim 1, further comprising a casing for engaging said insulating substrate in a first direction having a top plate including a protrusion extending therefrom so that when said casing is faced in a second direction opposite said first direction, said protrusion abuts the top of said coil terminals to prevent further movement of said casing.

5. An electro-magnet relay according to claim 1, wherein said insulating substrate includes a bottom surface and said coil terminals of said winding bobbin and said first and second contract terminals of said stationary leaf spring and said movable leaf spring, respectively, protrude in one line from said bottom surface of said insulating substrate.

6. An electro-magnetic relay according to claim 1, wherein said armature includes an upper surface having a recess formed therein, said recess being aligned with the axis of said leg piece located on said first end portion of said armature, a protrusion formed on said first side of said iron core and said protrusion being engageable with said recess.

7. An electro-magnetic relay according to claim 1, further comprising a wall member formed integrally with said insulating member and abutting said armature.

* * * * *